US009570031B2

(12) United States Patent
Yeo et al.

(10) Patent No.: US 9,570,031 B2
(45) Date of Patent: Feb. 14, 2017

(54) APPARATUS AND METHOD FOR MONITORING PIXEL DATA AND DISPLAY SYSTEM ADOPTING THE SAME

(71) Applicant: Samsung Display Co., Ltd., Yongin, Gyeonggi-Do (KR)

(72) Inventors: Dong-Hyun Yeo, Yongin-si (KR); Jae-Hyoung Park, Suwon-si (KR); Byung-Kil Jeon, Hwaseong-si (KR); Yong-Bum Kim, Suwon-si (KR); Suk-Jin Park, Daejeon (KR); Su-Hyun Jeong, Gwangju-si (KR); Eun-Seon Kim, Seoul (KR)

(73) Assignee: SAMSUNG DISPLAY CO., LTD, Gyeonggi-Do (KR)

( * ) Notice: Subject to any disclaimer, the term of this patent is extended or adjusted under 35 U.S.C. 154(b) by 80 days.

(21) Appl. No.: 14/531,129

(22) Filed: Nov. 3, 2014

(65) Prior Publication Data

US 2015/0348476 A1 Dec. 3, 2015

(30) Foreign Application Priority Data

Jun. 2, 2014 (KR) ..... 10-2014-0066935

(51) Int. Cl.

| | |
|---|---|
| ***G09G 3/3233*** | (2016.01) |
| ***G09G 3/3275*** | (2016.01) |
| ***G09G 3/36*** | (2006.01) |
| ***G09G 3/00*** | (2006.01) |

(52) U.S. Cl.

CPC ..... *G09G 3/3688* (2013.01); *G09G 3/006* (2013.01); *G09G 2310/0297* (2013.01)

(58) Field of Classification Search

CPC ..... G09G 3/3233; G09G 3/3275

See application file for complete search history.

(56) References Cited

U.S. PATENT DOCUMENTS

| | | | | |
|---|---|---|---|---|
| 5,959,604 | A | 9/1999 | Mosier | |
| 2008/0001880 | A1* | 1/2008 | Ki-Min | G09G 3/2007 345/89 |
| 2008/0158454 | A1* | 7/2008 | Shin | G09G 3/3607 349/36 |
| 2013/0100173 | A1* | 4/2013 | Chaji | G09G 5/10 345/690 |

(Continued)

FOREIGN PATENT DOCUMENTS

| | | | |
|---|---|---|---|
| KR | 1020090075906 | A | 7/2009 |
| KR | 1020120062397 | A | 6/2012 |
| KR | 1020150047964 | A | 5/2015 |

*Primary Examiner* — Ricardo L Osorio

(74) *Attorney, Agent, or Firm* — Cantor Colburn LLP

(57) ABSTRACT

An apparatus for monitoring pixel data includes a multiplexer configured to select pixel data applied to at least one of function blocks which is configured to convert the pixel data provided from an external device and adjust characteristics of a display device, a monitoring module configured to store the pixel data selected by the multiplexer, and an analyzing module configured to output a location selection signal to the multiplexer which provides the monitoring module with the pixel data based on the location selection signal, to read out the pixel data stored in the monitoring module by applying a pixel position signal to the monitoring module, and to analyze a variation of the read out pixel data.

19 Claims, 3 Drawing Sheets

(56) References Cited

U.S. PATENT DOCUMENTS

2014/0375704 A1* 12/2014 Bi ..... G09G 3/3275
345/694
2015/0154913 A1* 6/2015 Kim ..... G09G 3/3233
345/691

* cited by examiner

APPARATUS AND METHOD FOR MONITORING PIXEL DATA AND DISPLAY SYSTEM ADOPTING THE SAME

This application claims priority to Korean Patent Application No. 10-2014-0066935, filed on Jun. 2, 2014, and all the benefits accruing therefrom under 35 U.S.C. §119, the contents of which are herein incorporated by reference in their entirety.

BACKGROUND

1. Field

Exemplary embodiments of the invention relate to apparatus and method for monitoring pixel data and a display system adopting the monitoring apparatus. More particularly, exemplary embodiments of the invention relate to apparatus and method for monitoring a variation of pixel data applied to a display device and a display system adopting the monitoring apparatus.

2. Description of the Related Art

Generally, when an image is not displayed on a display panel or defects such as noise are generated, a data enable signal or a fail signal is analyzed by using a debug test point signal.

SUMMARY

Since a test point signal is omitted due to a downsizing of a printed circuit board ("PCB"), it is difficult to analyze a data enable signal or a fail signal when the test point signal does not exist or a measurement of the test point signal is difficult.

Moreover, it is difficult to check a variation of pixel data only by using a measuring a wave. That is, in a case of a compressed dynamic capacitance compensation ("DCC") noise which is capable of checking a variation of pixel data by comparing with a variation between a previous frame data and a current frame data or a dithering noise which is capable of temporally/spatially checking a progress of data variation, it is difficult to check the variation of pixel data.

Exemplary embodiments of the invention provide an apparatus for monitoring a variation of pixel data applied to a display device in order to diagnose a cause of display defects of the display device.

Exemplary embodiments of the invention also provide a method for performing the above-mentioned apparatus.

Exemplary embodiments of the invention also provide a display system adopting the above-mentioned apparatus.

According to one exemplary embodiment of the invention, an apparatus for monitoring pixel data includes a multiplexer ("MUX"), a monitoring module and an analyzing module. The MUX is configured to select pixel data applied to at least one of function blocks configured to convert the pixel data provided from an external device and to adjust characteristics of a display device. The monitoring module is configured to store the pixel data selected by the MUX. The analyzing module is configured to output a location selection signal to the MUX which provides the monitoring module with the pixel data based on the selection signal, to read out pixel data stored in the monitoring module by applying a pixel position signal to the monitoring module, and to analyze a variation of the read out pixel data.

In an exemplary embodiment of the invention, the analyzing module and the monitoring module may be connected to each other in an I2C bus.

In an exemplary embodiment of the invention, the analyzing module may be configured to perform a master function, and the monitoring module may be configured to perform a slave function.

In an exemplary embodiment of the invention, the display device may include a timing controller which provides a driving part configured to control an operation of a display panel which is configured to display an image with compensated pixel data and a driving signal. The function block may be disposed in the timing controller.

In an exemplary embodiment of the invention, the MUX and the monitoring module may be disposed in the timing controller.

In an exemplary embodiment of the invention, the analyzing module may be disposed in the external device.

In an exemplary embodiment of the invention, the MUX may further select pixel data outputted from the at least one of the function blocks when the pixel data applied to the at least one of the function blocks is selected.

According to another exemplary embodiment of the invention, there is provided a method for monitoring pixel data. In the method, pixel data are selected, which is applied to at least one of function blocks converting the pixel data provided from an external device so as to adjust characteristics of a display device. The selected pixel data are stored. The stored pixel data are read out. A variation of the read out pixel data is analyzed.

In an exemplary embodiment of the invention, a number of the function blocks may be plural and the plural function blocks may be connected in serial. The stored pixel data may be pixel data applied to at least one of the function blocks from among the plural function blocks.

In an exemplary embodiment of the invention, a number of the function blocks may be plural and the plural function blocks may be connected in serial. The stored pixel data may include pixel data applied to the function block and pixel data outputted from the function blocks from among the plural function blocks.

According to another exemplary embodiment of the invention, a display system includes a display apparatus and a pixel data monitoring apparatus. The display apparatus includes a display panel configured to display an image, a driving part configured to control an operation of the display panel, and a timing controller configured to provide the driving part with pixel data and a driving signal. The pixel data monitoring apparatus is configured to read out resister values within the timing controller by accessing the timing controller, and to monitor a variation of the pixel data.

In an exemplary embodiment of the invention, the timing controller may include at least one of function blocks configured to convert the pixel data and enhance characteristics of the image displayed on the display panel. The pixel data monitoring apparatus may monitor the variation of the pixel data by reading out pixel data applied to the at least one of the function blocks in every frame.

In an exemplary embodiment of the invention, the pixel data monitoring apparatus may include a MUX, a monitoring module and an analyzing module. The MUX may be configured to select pixel data applied to the function block. The monitoring module may be configured to store pixel data selected by the MUX. The analyzing module may be configured to output a location selection signal to the MUX which provides the monitoring module with the pixel data based on the location selection signal, to read out pixel data stored in the monitoring module by applying a pixel position signal to the monitoring module, and to analyze a variation of the read out pixel data.

In an exemplary embodiment of the invention, the analyzing module may vary the location selection signal to check pixel data outputted from each of the at least one of the function blocks of the timing controller.

In an exemplary embodiment of the invention, the analyzing module may vary the pixel position signal to monitor pixel data of a desired area within the display panel.

In an exemplary embodiment of the invention, the analyzing module and the monitoring module may be connected to each other in an I2C bus.

In an exemplary embodiment of the invention, the analyzing module may perform a master function, and the monitoring module may perform a slave function.

In an exemplary embodiment of the invention, the timing controller may include at least one of function blocks configured to convert the pixel data and enhance characteristics of the image displayed on the display panel. The pixel data monitoring apparatus may be configured to monitor the variation of before conversion pixel data applied to the at least one of the function blocks and after-conversion pixel data outputted from the at least one of the function blocks.

In an exemplary embodiment of the invention, the pixel data monitoring apparatus may include a MUX, a monitoring module and an analyzing module. The MUX may be configured to simultaneously select the before-conversion pixel data and the after-conversion pixel data. The monitoring module may be configured to store the before-conversion pixel data and the after-conversion pixel data which are selected by the MUX. The analyzing module may be configured to output a location selection signal to the MUX which provides the monitoring module with the before-conversion pixel data and the after-conversion pixel data. The analyzing module may be configured to read out the before-conversion pixel data and the after-conversion pixel data by applying a pixel position signal to the monitoring module. The analyzing module may analyze a variation of the read out pixel data.

In an exemplary embodiment of the invention, an operation of the pixel data monitoring apparatus may be performed during an operation interval during which an update of the pixel data is not generated.

According to some exemplary embodiments of the invention, a variation of pixel data is monitored, which is stored in a register map by using an I2C slave mode, so that a cause of display defects may be accurately diagnosed. Moreover, since an I2C slave mode block of a timing controller disposed in a display device is utilized, it may monitor pixel data without an additional logic design.

BRIEF DESCRIPTION OF THE DRAWINGS

The above and other features and exemplary embodiments of the invention will become more apparent by describing in detailed exemplary embodiments thereof with reference to the accompanying drawings, in which.

DETAILED DESCRIPTION OF THE INVENTION

Figure 1:
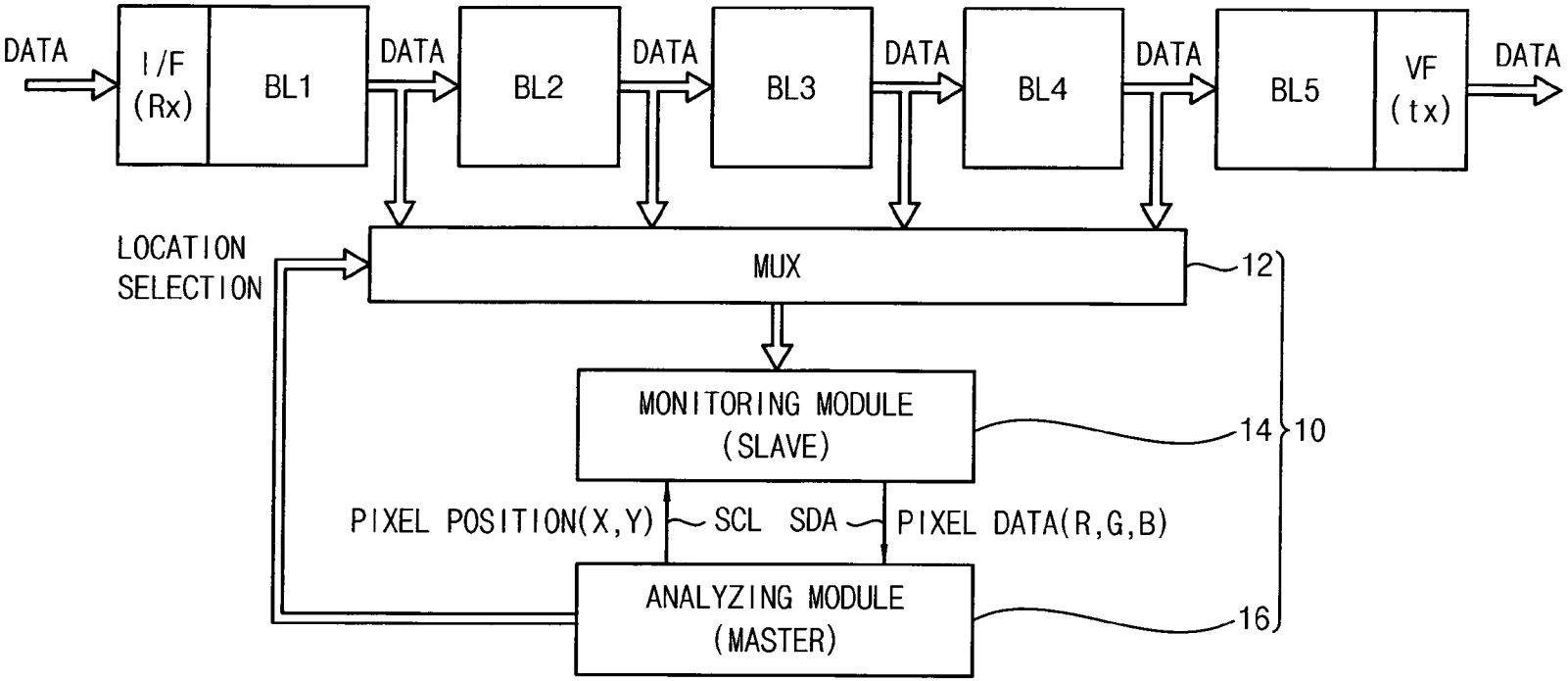
FIG. 1 is a block diagram for illustrating an exemplary embodiment of a pixel data monitoring apparatus according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example In an exemplary embodiment, if when the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, the invention will be explained in detail with reference to the accompanying drawings.

FIG. 1 is a block diagram for illustrating a pixel data monitoring apparatus 10 according to an exemplary embodiment of the invention.

Referring to FIG. 1, the pixel data monitoring apparatus 10 according to an exemplary embodiment of the invention includes a multiplexer ("MUX") 12, a monitoring module 14 and an analyzing module 16 to monitor and analyze a variation of pixel data applied to at least one of a plurality of function blocks which converts pixel data so as to adjust characteristics of a display device. In FIG. 1, the function blocks includes a first function block BL1, a second function block BL2, a third function block BL3, a firth function block BL4 and a fifth function block BL5. The first to fifth function blocks BL1, BL2, BL3, BL4 and BL5 are connected in serial. The first function block BL1 receives pixel data from an external host (not shown) through a receiving interface I/F(Rx), and the fifth function block BL5 outputs pixel data having enhanced display characteristics through a transmitting interface VF(tx).

The MUX 12 selects pixel data applied to the function blocks connected in serial in response to a location selection signal applied to the analyzing module 16. That is, the MUX 12 may select pixel data applied to one of the first to fifth function blocks BL1, BL2, BL3, BL4 and BL5 in accordance with the location selection signal.

The monitoring module 14 stores pixel data selected by the MUX 12. The monitoring module 14 may include a memory which stores pixel data per frames. In the illustrated exemplary embodiment, the monitoring module 14 may be a memory capable of storing pixel data during the maximum 32-frames, for example. In this case, a size of the memory may be increased in accordance with the number of frames and bit number of red, green and blue ("RGB") pixel data.

The analyzing module 16 outputs the location selection signal to the MUX 12, so that the pixel data is provided to the monitoring module 14. Moreover, the analyzing module 16 applies a pixel position signal to the monitoring module 14 to read out pixel data stored in the monitoring module 14, and analyzes a variation of the read pixel data. In the illustrated exemplary embodiment, since the pixel position signal is applied to the monitoring module 14, pixel data corresponding to pixel of desired position within a display panel may be selected. The analyzing module 16 may read out plural pixel data every frame in correspondence with a particular pixel, so that a variation of pixel data may be analyzed.

In an exemplary embodiment, the analyzing module 16 and the monitoring module 14 may be connected to each other in an inter-integrated circuit bus ("I2C bus"), for example. The I2C bus includes a serial clock line SCL for sending clock pulses and a serial data line SDA for serially sending data, and sends and receives data according to clock pulses. Further, devices connected to the I2C bus communicate as a master and a slave. The I2C protocol is a serial bus protocol capable of supporting communications with a plurality of slaves which are connected through the two lines SCL and SDA and power lines to send and receive data.

In the illustrated exemplary embodiment, the analyzing module 16 performs a master function, and the monitoring module 14 performs a slave function, for example. That is, the analyzing module 16 is connected to the monitoring module 14 through two lines SCL and SDA. The analyzing module 16 performs a read operation or a write operation for input/output ("I/O") devices on an I2C bus by using an I2C bus controller (not shown) so as to control I/O devices supporting I2C protocol.

Moreover, the analyzing module 16 generates a clock signal pulse as a device which initiates transmitting, and plays a role of ending the transmitting. The monitoring module 14 is a device which is addressed by the analyzing module 16. When the analyzing module 16 makes a start condition, the monitoring module 14 that is a slave device connected to a bus waits for following data.

When the analyzing module 16 transmits a slave address, the monitoring module 14 compares with the slave address and its own unique address. When the slave address and the unique address are equal to each other, the monitoring module 14 transmits a response to the analyzing module 16 during an acknowledgement signal interval. Thus, the analyzing module 16 may transmit data to the monitoring module 14 or may receive data from the monitoring module 14. In an alternative exemplary embodiment, the monitoring module 14 may transmit data to the analyzing module 16 or may receive data from the analyzing module 16. When data transmitting and receiving are finished, a master makes a stop status and disconnects a bus interface.

The display device may include a timing controller which provides a driving part controlling a display panel displaying images with pixel data and a driving signal. In an exemplary embodiment, the function block is disposed in the timing controller. In the illustrated exemplary embodiment, the MUX 12 and the monitoring module 14 may be disposed in the timing controller.

In an exemplary embodiment, the analyzing module 16 is disposed in an external device (not shown). In an exemplary embodiment, the external device may be a main frame of computer on which a graphic controller is disposed so as to realize a display system, for example. In another exemplary embodiment, the external device may be a test device which tests whether an operation of a display device is performed or not.

In the illustrated exemplary embodiment, an operation of the pixel data monitoring apparatus 10 is performed during an operation interval during which an update of the pixel data is not generated, for example, an operation interval that an initialization operation is performed or a display operation is performed. When an update of pixel data is generated during the analyzing module 16 is accessing to the monitoring module 14, the pixel data are continuously varied so that it is difficult to analyze a variation of the pixel data.

In the illustrated exemplary embodiment, it is described that the MUX 12 selects pixel data applied to the function block. In an alternative exemplary embodiment, the MUX 12 may further select pixel data output from the function block when the pixel data applied to the function block are selected. Here, the pixel data applied to the function block are before-conversion pixel data, and the pixel data outputted from the function are after-conversion pixel data.

When the MUX 12 simultaneously selects the before-conversion pixel data and the after-conversion pixel data, the before-conversion pixel data and the after-conversion pixel data are stored in the monitoring module 14. The analyzing module 16 applies a pixel position signal to the monitoring module 14 to analyze a variation of pixel data by reading out the before-conversion pixel data and the after-conversion pixel data stored in the monitoring module 14. In an exemplary embodiment, the pixel position signal may include a position of a pixel in X-axis and Y-axis.

Figure 2:
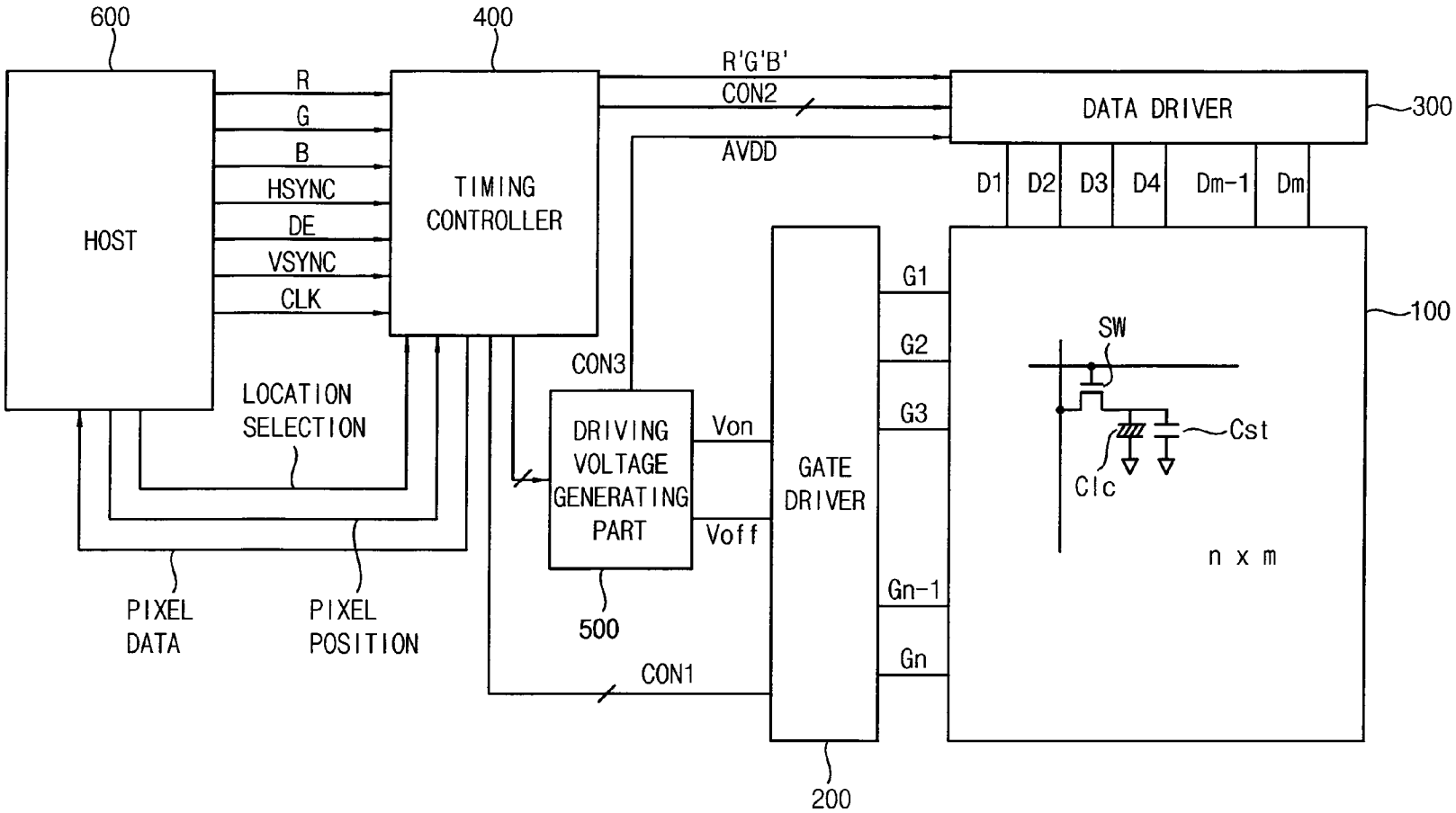
FIG. 2 is a block diagram explaining a display system having a monitoring apparatus of pixel data adopted thereto.

FIG. 2 is a block diagram explaining a display system having a monitoring apparatus of pixel data adopted thereto.

Referring to FIG. 2, a display system according to an exemplary embodiment of the invention includes a liquid crystal display panel 100, a gate driver 200, a data driver 300, a timing controller 400, a driving voltage generating part 500 and a host 600.

The liquid crystal display panel 100 includes a thin-film transistor SW and a liquid crystal capacitor Clc that are connected to plural gate lines G1 to Gn and plural data lines D1 to Dm and storage capacitor Cst to display images.

In an exemplary embodiment, the liquid crystal display panel 100 includes the plurality of gate lines G1-Gn extending in a first direction, the plurality of data lines D1-Dm extending in a second direction crossing to the gate lines G1 to Gn, and a pixel region defined at the respective intersections of the gate lines G1 to Gn and the data lines D1-Dm, for example. However, the invention is not limited thereto, and the pixel region may not be defined by the gate lines G1 to Gn and the data lines D1-Dm. Pixels each having the thin-film transistor SW, the storage capacitor Cst, and the liquid crystal capacitor Clc are provided in the pixel region. In an exemplary embodiment, the pixels may include a red (R) pixel, a green (G) pixel, and a blue (B) pixel, for example. In an exemplary embodiment, the R pixel, the G pixel, and the B pixel are sequentially arranged in odd-numbered rows, and the B pixel, the R pixel, and the G pixel are sequentially arranged in even-numbered rows. However, the invention is not limited thereto, and other pixel arrangements are also possible.

In an exemplary embodiment, the thin-film transistor SW includes a gate electrode, a source electrode and a drain electrode. Each of the gate electrodes is connected to the gate lines G1-Gn, each of the sources is connected to the data lines D1-Dm, and each of the drains is connected to the storage capacitor Cst and the liquid crystal capacitor Clc. When the thin-film transistor SW operates in response to the gate driving signals applied to the gate lines G1-Gn and the data signals are applied through the data lines D1-Dm to the pixel electrodes, electric fields across the liquid crystal capacitors Clc are changed. Due to the changed electric fields, the arrangement of the liquid crystals is changed and thus the transmittance of light supplied from a backlight (not shown) is controlled.

The gate driver 200, the data driver 300, the timing controller 400 and the driving voltage generating part 500 are provided outside the liquid crystal display panel 100 and supply a plurality of signals for the operation of the liquid crystal display panel 100. In an exemplary embodiment, the gate driver 200 may be disposed on the liquid crystal display panel 100. In an exemplary embodiment, the data driver 300 may be mounted on the liquid crystal display panel 100, or may be mounted on a separate printed circuit board ("PCB") and electrically connected to the PCB panel 100 through a flexible PCB ("FPC"). In an exemplary embodiment, the timing controller 400 and the driving voltage generating part 500 may be mounted on a PCB and electrically connected to the liquid crystal display panel 100 through a FPC.

The timing controller 400 controls the gate driver 200 and the data driver 300 by using control signals R, G, B, DE, Hsync, Vsync and CLK provided from the host 600.

In another exemplary embodiment, the timing controller 400 receives image data and display control signals from an external graphic controller (not shown), for example. In an exemplary embodiment, the image data include pixel data R, G and B, and the display control signals include a horizontal sync signal Hsync, a vertical sync signal Vsync, a main clock CLK, and a data enable signal DE. In an exemplary embodiment, the timing controller 400 performs an initialization operation, a display operation, and an update operation in this order.

The initialization operation includes reading initialization data from an internal or external memory and setting the data to allow the timing controller 400 to operate. Examples of the initialization data include a resolution, a timing, a color correction, a response time compensation, and a driving voltage setting.

The display operation is to process the pixel data according to the operation conditions of the liquid crystal display panel 100 and generate a gate control signal CON1 and a data control signal CON2 respectively to the gate driver 200 and the data driver 300. In an exemplary embodiment, the gate control signal CON1 includes a vertical sync start signal indicating the output start of a gate turn-on voltage Von, a gate clock signal for controlling an output timing of the gate turn-on voltage Von, and an output enable signal for controlling a duration of the gate turn-on voltage Von. In an exemplary embodiment, the data control signal CON2 includes a horizontal sync start signal indicating the transfer start of the pixel data, a load signal instructing the loading of a data voltage on the corresponding data line, an inversion signal for inverting a polarity of a gray scale voltage with respect to a common voltage, and a data clock signal.

When a setting is changed during the display operation, the update operation is performed simultaneously with the display operation. In the update operation, update data stored in the memory are received and applied to the image display in a blank period between frames. In the update operation, the timing controller 400 receives update data stored in an inner memory and applies to the image display in a blank period between frames.

The driving voltage generating part 500 generates the driving voltages Von, Voff and AVDD to the gate driver 200 and the data driver 300 according to the output signals of the timing controller 400.

In an exemplary embodiment, the driving voltage generating part 500 generates a variety of driving voltages necessary for the operation of the display system by using external voltages supplied from an external power supply according to a control signal CON3 output from the timing controller 400, for example. The driving voltage generating part 500 generates the reference voltage AVDD, the gate turn-on voltage Von, the gate turn-off voltage Voff, and the common voltage. The driving voltage generating part 500 applies the gate turn-on voltage Von and the gate turn-off voltage Voff to the gate driver 200 and the reference voltage AVDD to the data driver 300 according to the control signals output from the timing controller 400. The reference voltage AVDD is used as a reference voltage to generate gray scale voltages for driving the liquid crystals.

The gate driver 200 is connected to the gate lines GL1-Gn and controls an operation of the thin-film transistor SW.

In an exemplary embodiment, the gate driver 200 applies the gate turn-on voltage and the gate turn-off voltage Voff to the gate lines G1-Gn according to the gate control signal CON1 output from the timing controller 500, for example. In this way, the thin-film transistor SW may be controlled to apply the gray scale voltages to the corresponding pixels.

The data driver 300 controls a data signal applied to the liquid crystal capacitor Clc and the storage capacitor Cst through the thin-film transistor SW.

In an exemplary embodiment, the data driver 300 generates the gray scale voltages by using the data control signal CON2 output from the timing controller 400 and the reference voltage AVDD output from the driving voltage generating part 500, and applies the generated gray scale voltages to the data lines D1-Dm, for example. That is, the data driver 300 converts digital pixel data, based on the reference voltage AVDD, to generate analog data signals, that is, the gray scale voltages.

The host 600 accesses to the timing controller 400 to read out register values within the timing controller 400 to perform a function of monitoring a variation of the pixel data. In an exemplary embodiment, the host 600 and the timing controller 400 are connected to each other in an I2C bus, for example. In the exemplary embodiment, the host 600 performs a master function, and the timing controller 400 performs a slave function, for example.

In order to monitor a variation of the pixel data, an interval that the host 600 accesses to the timing controller 400 is an operation interval during which an update of the pixel data is not generated, for example, an initialization operation or a display operation.

Figure 3:
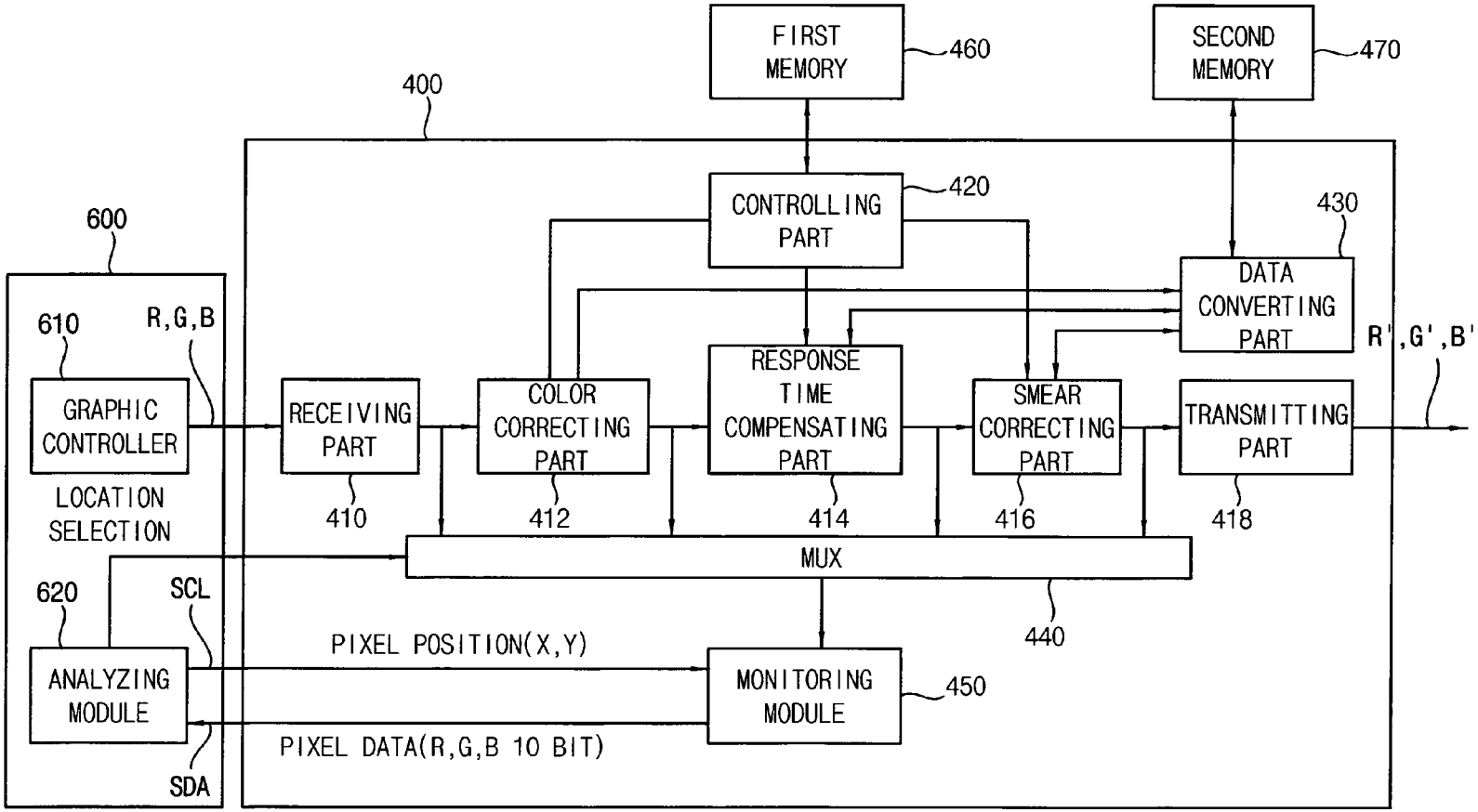
FIG. 3 is a block diagram explaining the timing controller and peripheral thereof shown in FIG. 2 in order to explain a pixel data monitoring apparatus.

FIG. 3 is a block diagram explaining the timing controller and peripheral thereof shown in FIG. 2 in order to explain a pixel data monitoring apparatus.

Referring to FIGS. 2 and 3, the timing controller 400 includes a receiving part 410, a color correcting part 412, a response time compensating part 414, a smear correcting part 416, transmitting part 418, a controlling part 420, a data converting part 430, a MUX 440 and a monitoring module 450. A signal generator which generates a variety of clock signals, a buffer which synchronizes with pixel data and clock signals, a setting part which sets a resolution and a timing, a control signal which generating part which generates a control signal, etc., are not shown in FIG. 3.

Moreover, a first memory 460 and a second memory 470 storing a variety of information for driving the timing controller 400 are disposed at an exterior of the timing controller 400. In an alternative exemplary embodiment, the first memory 460 and the second memory 470 may be disposed at an interior of the timing controller 400.

In an exemplary embodiment, the first memory 460 is implemented with a nonvolatile memory such as EEPROM, and stores the resolution and timing data, the option data, the color data, the response time compensation data, and the voltage data, for example.

In an exemplary embodiment, the second memory 470 is implemented with a volatile memory such as DRAM, and stores the color data corrected by the color correcting part 412, for example. The second memory 470 may also store the data synchronized with the internal clock signals by the receiving part 410 according to the structure of the timing controller 400.

The receiving part 410 receives an image signal, that is, pixel data R, G, B from a graphic controller 610 disposed at a host 600, and provides the color correcting part 412 with the pixel data.

The color correcting part 412 color-corrects the pixel data provided from the receiving part 410, and provides the response time compensating part 414 with the color-corrected pixel data. In an exemplary embodiment, the color correcting part 412 receives the pixel data R, G and B stored in the first memory 460 through the controlling part 420 and corrects the received pixel data R, G and B by using the stored color correction data, for example. That is, after storing the color correction data, the color correction part 412 corrects at least one of the R data, the G data, and the B data by using the color correction data. Here, the color correction data may be previously determined and stored according to the characteristics of the liquid crystal display panel 100 in its manufacturing process.

The response time compensating part 414 compensates the response time of the pixel data provided from the color correcting part 412, and provides the smear correcting part 416 with the compensated pixel data. In an exemplary embodiment, the response time compensating part 414 compares data of a previous frame with data of a current frame and reduces time necessary to convert the data of the current frame. Since the response time of the liquid crystal display panel 100 is slower than the variation of the applied voltage, the operation of the liquid crystal display panel 100 is not completely changed even though the data has been changed. Therefore, an overdriving is performed to further change the data so as to approach the response time of the liquid crystal display panel 100. To this end, the response time compensating part 414 receives the pixel data of the previous frame stored in the second memory 470 through the data converting part 430, compares it with the pixel data of the current frame corrected by the color correcting part 412, and then compensates the response time. At this point, the degree of the overdriving is previously set. The response time compensation data are stored in the first memory 460. Therefore, the response time compensating part 414 receives the response time compensation data from the first memory 460 through the controlling part 420, stores the received response time compensation data, and then compensates the response time.

The smear correcting part 416 compensates a smear of the compensated pixel data provided from the response time compensating part 414, and provides the transmitting part 418 with the smear compensated pixel data.

The transmitting part 418 provides the data driver 300 (shown in FIG. 2) with the smear compensated pixel data R', G' and B'.

The controlling part 420 transfers operation information of the timing controller 400. In an exemplary embodiment, the controlling part 420 transfers various data stored in a first memory 460 to each elements of the timing controller 400. That is, the controlling part 420 transfers the color correcting data stored in the first memory 460 to the color correcting part 412, the transmits response time compensation data and the update data to the response time compensating part 414, and transmits the smear correction data to the smear correcting part 416.

The data converting part 430 converts data formats of the inside or outside of the timing controller 400. In an exemplary embodiment, the data converting part 430 may convert color data, which are corrected by the color correcting part 412, into data suitable for the data formats of the second memory 470 to store the converted color data in the second memory 470, and may convert the color data stored in the second memory 470 into data suitable for the internal formats of the timing controller 400 to deliver the color data in the response time compensating part 414. Moreover, in accordance with a configuration of the timing controller 400, the data converting part 430 may convert data synchronized with an internal clock signal of the timing controller 400 into data suitable for the data formats of the second memory 470 to store the converted data in the second memory 470, and may convert the synchronized data stored in the second memory 470 into data suitable for the internal formats of the timing controller 400 to deliver the data in the color correcting part 412.

The MUX 440 selects pixel data applied to a function block, for example, the color correcting part 412, the response time compensating part 414 and the smear correcting part 416, which converts pixel data provided from an analyzing module 620 of the host 600 to be suitable for characteristics of a display device.

In an exemplary embodiment, the MUX 440 may select one of the color correcting part 412, the response time compensating part 414 and the smear correcting part 416, and may provide the monitoring module 450 with pixel data applied to the selected part, for example.

In another exemplary embodiment, the MUX 440 may select one of the color correcting part 412, the response time compensating part 414 and the smear correcting part 416, and may provide the monitoring module 450 with pixel data applied to the selected part and pixel data outputted from the selected part.

The monitoring module 450 stores pixel data selected by the MUX 440.

In an exemplary embodiment, the analyzing module 620 and the monitoring module 450 are connected to each other in an I2C bus. In the illustrated exemplary embodiment, the analyzing module 620 performs a master function, and the monitoring module 450 performs a slave function. The analyzing module 620 outputs a location selection signal to the MUX 440 so as to provide the monitoring module 450 with the pixel data, read out pixel data stored in the monitoring module 450 by applying a pixel position signal to the monitoring module 450, and analyzes a variation of the read out pixel data. In an exemplary embodiment, the monitoring module 450 may output 10 bit pixel data, for example.

The analyzing module 620 varies the location selection signal to check pixel data outputted from every function block of the timing controller. In an exemplary embodiment, the analyzing module 620 checks pixel data outputted from the color correcting part 412, pixel data outputted from the response time compensating part 414, or pixel data outputted from the smear correcting part 416.

The analyzing module 620 may vary the pixel position signal to monitor pixel data of a desired area within the display panel.

In an exemplary embodiment, the analyzing module 620 may check a variation of pixel data during the maximum 32-frames by using an internal memory, for example. In exemplary embodiments, the internal memory may be disposed in the host 600 or the timing controller 400.

In the illustrated exemplary embodiment, an operation of the monitoring module 450 and an operation of the analyzing module 620 may be performed during an operation interval during which an update of the pixel data is not generated. When an update of pixel data is generated during the analyzing module 620 is accessing, the pixel data are continuously varied so that it is difficult to analyze a variation of the pixel data.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. An apparatus for monitoring pixel data, comprising:

a multiplexer which selects pixel data applied to at least one of a plurality of function blocks which converts the pixel data provided from an external device and adjusts characteristics of a display device;

a monitoring module which stores the pixel data selected by the multiplexer; and an analyzing module which outputs a location selection signal to the multiplexer which provides the monitoring module with the pixel data based on the location selection signal, reads out the pixel data stored in the monitoring module by applying a pixel position signal to the monitoring module, and analyses a variation of the read out pixel data.

2. The apparatus of claim 1, wherein the analyzing module and the monitoring module are connected to each other in an I2C bus.

3. The apparatus of claim 2, wherein the analyzing module performs a master function, and the monitoring module performs a slave function.

4. The apparatus of claim 1, wherein the display device comprises a timing controller which provides a driving part which controls an operation of a display panel which displays an image with compensated pixel data and a driving signal, and wherein the at least one of the function blocks is disposed in the timing controller.

5. The apparatus of claim 4, wherein the multiplexer and the monitoring module are disposed in the timing controller.

6. The apparatus of claim 1, wherein the analyzing module is disposed in the external device.

7. The apparatus of claim 1, wherein the multiplexer further selects pixel data outputted from the at least one of the function blocks when the pixel data applied to the at least one of the function blocks is selected.

8. A method for monitoring pixel data, the method comprising:

selecting pixel data applied to at least one of a plurality of function blocks converting the pixel data provided from an external device so as to adjust characteristics of a display device;

storing the selected pixel data in a monitoring module;

outputting a location selection signal to a multiplexer which provides the monitoring module with the selected pixel data based on the location selection signal;

reading out the stored pixel data stored in the monitoring module by applying a pixel position signal to the monitoring module; and analyzing a variation of the read out pixel data.

9. The method of claim 8, wherein a number of the function blocks is plural and the plural function blocks are connected in serial, and wherein the stored pixel data are pixel data applied to at least one of the function blocks from among the plural function blocks.

10. The method of claim 8, wherein a number of the function blocks is plural and the plural function blocks are connected in serial, and wherein the stored pixel data comprises pixel data applied to the function blocks and pixel data outputted from the function blocks, from among the plural function blocks.

11. A display system comprising:

a display apparatus comprising a display panel which display an image, a driving part which controls an operation of the display panel, and a timing controller which provides the driving part with pixel data and a driving signal; and a pixel data monitoring apparatus which reads out resister values within the timing controller by accessing the timing controller, and monitors a variation of the pixel data, wherein the timing controller comprises at least one of a plurality of function blocks which converts the pixel data and enhances characteristics of the images displayed on the display panel, wherein the pixel data monitoring apparatus monitors variation of the pixel data by reading out pixel data applied to the at least one of the function blocks in every frame, and wherein the pixel data monitoring apparatus comprises:

a multiplexer which selects pixels data applied to the at least one of the function blocks, a monitoring module which stores the pixel data selected by the multiplexer, and an analyzing module which outputs a location selection signal to the multiplexer which provides the monitoring module with the pixel data based on the location selection signal, reads out the pixel data stored in the monitoring module, and analyzes a variation of the read out pixel data.

12. The display system of claim 11, wherein the analyzing module which reads out the pixel data stored in the monitoring module by applying a pixel position signal to the monitoring module.

13. The display system of claim 11, wherein the analyzing module varies the location selection signal to check pixel data outputted from each of the at least one of the function blocks of the timing controller.

14. The display system of claim 11, wherein the analyzing module varies the pixel position signal to monitor pixel data of a desired area within the display panel.

15. The display system of claim 11, wherein the analyzing module and the monitoring module are connected to each other in an I2C bus.

16. The display system of claim 15, wherein the analyzing module performs a master function, and the monitoring module performs a slave function.

17. The display system of claim 11, wherein an operation of the pixel data monitoring apparatus is performed during an operation interval during which an update of the pixel data is not generated.

18. A display system comprising:

a display apparatus comprising a display panel which display an image, a driving part which controls an operation of the display panel, and a timing controller which provides the driving part with pixel data and a driving signal; and a pixel data monitoring apparatus which reads out resister values within the timing controller by accessing the timing controller, and monitors a variation of the pixel data, wherein the timing controller comprises at least one of a plurality of function blocks which converts the pixel data and enhances characteristics of the image displayed on the display panel, wherein the pixel data monitoring apparatus monitors the variation of before-conversion pixel data applied to the at least one of a plurality of the function blocks and after-conversion pixel data outputted from the at least one of the function blocks, and wherein the pixel data monitoring apparatus comprises:

a multiplexer which simultaneously selects the before-conversion pixel data and the after-conversion pixel data;

a monitoring module which stores the before-conversion pixel data and the after-conversion pixel data which are selected by the multiplexer, and an analyzing module which outputs a location selection signal to the multiplexer which provides the monitoring module with the before-conversion pixel data and the after-conversion pixel data base on the location selection signal, reads out the before-conversion pixel data and the after-conversion pixel data, and analyzes a variation of the read out pixel data.

19. The display system of claim 18, wherein the analyzing module reads out the before-conversion pixel data and the after-conversion pixel data by applying a pixel position signal to the monitoring module.

* * * * *